US009859658B2

(12) United States Patent
Champion et al.

(10) Patent No.: US 9,859,658 B2
(45) Date of Patent: Jan. 2, 2018

(54) ELECTRICAL CONNECTOR HAVING RESONANCE CONTROLLED GROUND CONDUCTORS

(71) Applicant: Tyco Electronics Corporation, Berwyn, PA (US)

(72) Inventors: Bruce Allen Champion, Camp Hill, PA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/712,370

(22) Filed: May 14, 2015

(65) Prior Publication Data

US 2016/0336692 A1 Nov. 17, 2016

(51) Int. Cl.
*H01R 13/6471* (2011.01)
*H01R 13/6585* (2011.01)
*H01R 12/72* (2011.01)

(52) U.S. Cl.
CPC ..... *H01R 13/6471* (2013.01); *H01R 12/721* (2013.01); *H01R 13/6585* (2013.01)

(58) Field of Classification Search
CPC ..... H01R 13/6471; H01R 13/6585; H01R 12/721
See application file for complete search history.

(56) References Cited

U.S. PATENT DOCUMENTS

| | | | | |
|---|---|---|---|---|
| 6,709,294 | B1 | 3/2004 | Cohen et al. | |
| 6,786,771 | B2 | 9/2004 | Gailus | |
| 7,163,421 | B1 | 1/2007 | Cohen et al. | |
| 7,335,063 | B2 | 2/2008 | Cohen et al. | |
| 7,371,117 | B2 | 5/2008 | Gailus | |
| 7,581,990 | B2 | 9/2009 | Kirk et al. | |
| 7,753,731 | B2 | 7/2010 | Cohen et al. | |
| 7,771,233 | B2 | 8/2010 | Gailus | |
| 8,177,564 | B1 | 5/2012 | Ito et al. | |
| 8,272,877 | B2 * | 9/2012 | Stokoe | H01R 23/688 439/55 |
| 8,371,875 | B2 | 2/2013 | Gailus | |
| 8,480,413 | B2 * | 7/2013 | Minich | H01R 12/724 439/607.05 |
| 8,523,583 | B2 | 9/2013 | Ito | |
| 2013/0109232 | A1 * | 5/2013 | Paniaqua | H01R 13/6581 439/607.07 |

* cited by examiner

*Primary Examiner* — James Harvey
*Assistant Examiner* — Oscar C Jimenez

(57) ABSTRACT

An electrical connector includes a housing and a plurality of ground wafers and signal wafers. A front side is configured to mate with a mating connector. The ground wafers and signal wafers are stacked next to one another along a stack axis. The ground wafers are interleaved between adjacent pairs of the signal wafers. Each signal wafer includes at least one signal conductor held by a signal holder that is composed of a first material. Each ground wafer includes at least one ground conductor held by a ground holder that is composed of second material. The second material is a lossy material and the first material is a low loss dielectric material that has a loss tangent that is lower than a loss tangent of the lossy material. The signal conductors and the ground conductors are configured to engage and electrically connect to the mating connector.

20 Claims, 6 Drawing Sheets

ELECTRICAL CONNECTOR HAVING RESONANCE CONTROLLED GROUND CONDUCTORS

BACKGROUND

The subject matter herein relates generally to electrical connectors that have signal conductors configured to convey data signals and ground conductors that control impedance and reduce crosstalk between the signal conductors.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors control impedance and reduce crosstalk between the signal conductors. In differential signaling applications, the signal conductors are arranged in signal pairs for carrying the data signals. Each signal pair may be separated from an adjacent signal pair by one or more ground conductors.

There has been a general demand to increase the density of signal conductors within the electrical connectors and/or increase the speeds at which data is transmitted through the electrical connectors. As data rates increase and/or distances between the signal conductors decrease, however, it becomes more challenging to maintain a baseline level of signal integrity. For example, in some cases, electrical energy that propagates on the surface of each ground conductor of the electrical connector may be reflected and resonate within cavities formed between ground conductors. Depending on the frequency of the data transmission, electrical noise may develop that increases return loss and/or crosstalk and reduces throughput of the electrical connector.

Accordingly, there is a need for electrical connectors that reduce the electrical noise caused by resonating conditions between ground conductors.

BRIEF DESCRIPTION

In an embodiment, an electrical connector is provided that includes a housing and a plurality of ground wafers and signal wafers. The housing has a mounting side and a front side. The front side is configured to mate with a mating connector. The ground wafers and signal wafers are stacked next to one another along a stack axis. The signal wafers are stacked in pairs and the ground wafers are interleaved between adjacent pairs of the signal wafers. Each signal wafer includes at least one signal conductor held by a signal holder that is composed of a first material. Each ground wafer includes at least one ground conductor held by a ground holder that is composed of second material. The second material is a lossy material and the first material is a low loss dielectric material that has a loss tangent that is lower than a loss tangent of the lossy material. The signal conductors and the ground conductors are configured to engage and electrically connect to the mating connector.

In an aspect, the low loss dielectric material of the signal holders has a loss tangent that is at least ten times lower than a loss tangent of the lossy material of the ground holders.

In another embodiment, an electrical connector is provided that includes a housing and a plurality of ground wafers and signal wafers. The housing has a mounting side and a front side. The front side is configured to mate with at least one mating connector. The ground wafers and signal wafers are stacked next to one another along a stack axis.

The signal wafers are stacked in pairs and the ground wafers are interleaved between adjacent pairs of the signal wafers. Each signal wafer includes at least two signal conductors held by a signal holder that is composed of a low loss dielectric material. Each ground wafer includes at least two ground conductors held by a ground holder. A first portion of the ground holder of each ground wafer is composed of a lossy material and a second portion of the ground holder is composed of a low loss dielectric material. The low loss dielectric material of the signal holder and the low loss dielectric material of the second portion of the ground holder both have a respective loss tangent that is lower than a loss tangent of the lossy material of the first portion of the ground holder. The signal conductors and the ground conductors are each configured to engage and electrically connect to one mating connector.

DETAILED DESCRIPTION

Figure 1:
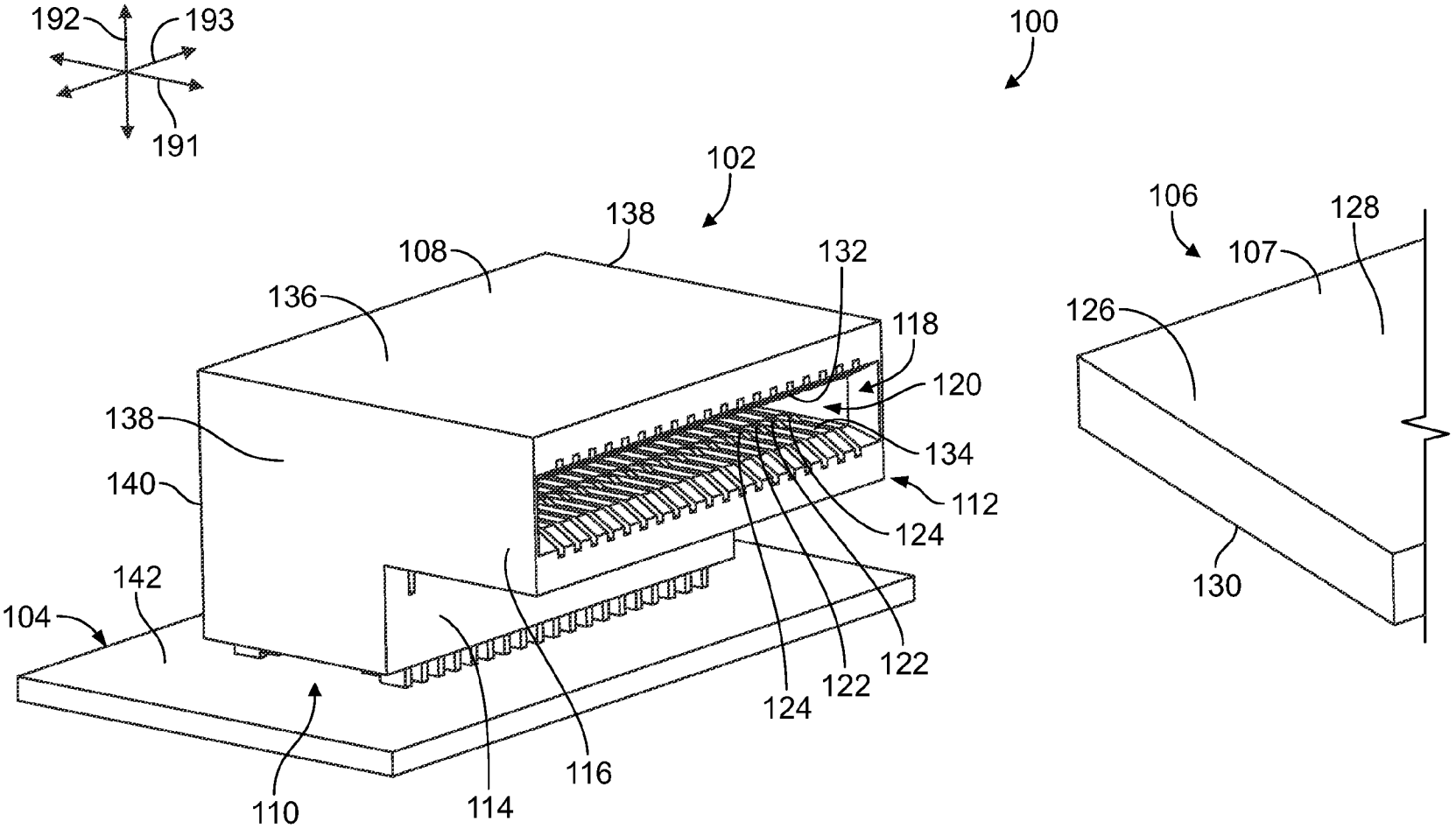
FIG. 1 is a perspective view of a connector system according to an embodiment.

FIG. 1 is a perspective view of a connector system 100 according to an embodiment. The connector system 100 includes a first electrical connector 102 that is mounted on a host circuit board 104. The connector system 100 further includes a second electrical connector 106 that is configured to mate with the first electrical connector 102. As used herein, the first electrical connector 102 is referred to as "electrical connector", and the second electrical connector 106 is referred to as "mating connector". The mating connector 106 is or includes a circuit card 107 (or circuit board) in the illustrated embodiment. For example, although only the circuit card 107 is shown in FIG. 1, the mating connector 106 may include a shell (not shown) that at least partially surrounds the circuit card 107. Signals (such as data and/or power signals) are transmitted between the mating connector 106 and the host circuit board 104 through the electrical connector 102. The connector system 100 is oriented with respect to a longitudinal axis 191, an elevation axis 192, and a lateral axis 193. The axes 191-193 are mutually perpendicular. Although the elevation axis 192 appears to extend in a vertical direction parallel to gravity in FIG. 1, it is understood that the axes 191-193 are not required to have any particular orientation with respect to gravity.

In particular embodiments, the connector system 100 may be a backplane or midplane interconnection system such that the electrical connector 102 and the host circuit board 104 form a backplane or midplane assembly, and the mating connector 106 forms a daughter card assembly. The daughter card assembly may be referred to as a line card or a switch card. In the illustrated embodiment, only a single electrical connector 102 is shown mounted to the host circuit board 104, but in other embodiments the host circuit board 104 may include multiple electrical connectors mounted thereto. Although only one mating connector 106 is shown in FIG. 1, the electrical connector 102 may be configured to mate with two or more mating connectors in alternative embodiments.

The connector system 100 may be used in various applications that utilize ground conductors for controlling impedance and reducing crosstalk between signal conductors. By way of example only, the connector system 100 may be used in telecom and computer applications, routers, servers, and supercomputers. One or more of the electrical connectors described herein may be similar to electrical connectors of the STRADA Whisper, Z-PACK TinMan, or the pluggable input/output (I/O) product lines developed by TE Connectivity. The electrical connectors may be capable of transmitting data signals at high speeds, such as 5 gigabits per second (Gb/s), 10 Gb/s, 20 Gb/s, 30 Gb/s, or more. In more particular embodiments, the electrical connectors may be capable of transmitting data signals at 40 Gb/s, 50 Gb/s, or more. The electrical connectors may include high-density arrays of signal conductors that engage corresponding contacts of a mating connector. A high-density array may have, for example, signal conductors on a 0.8 mm or less contact pitch along a front side of the electrical connector.

Figure 2:
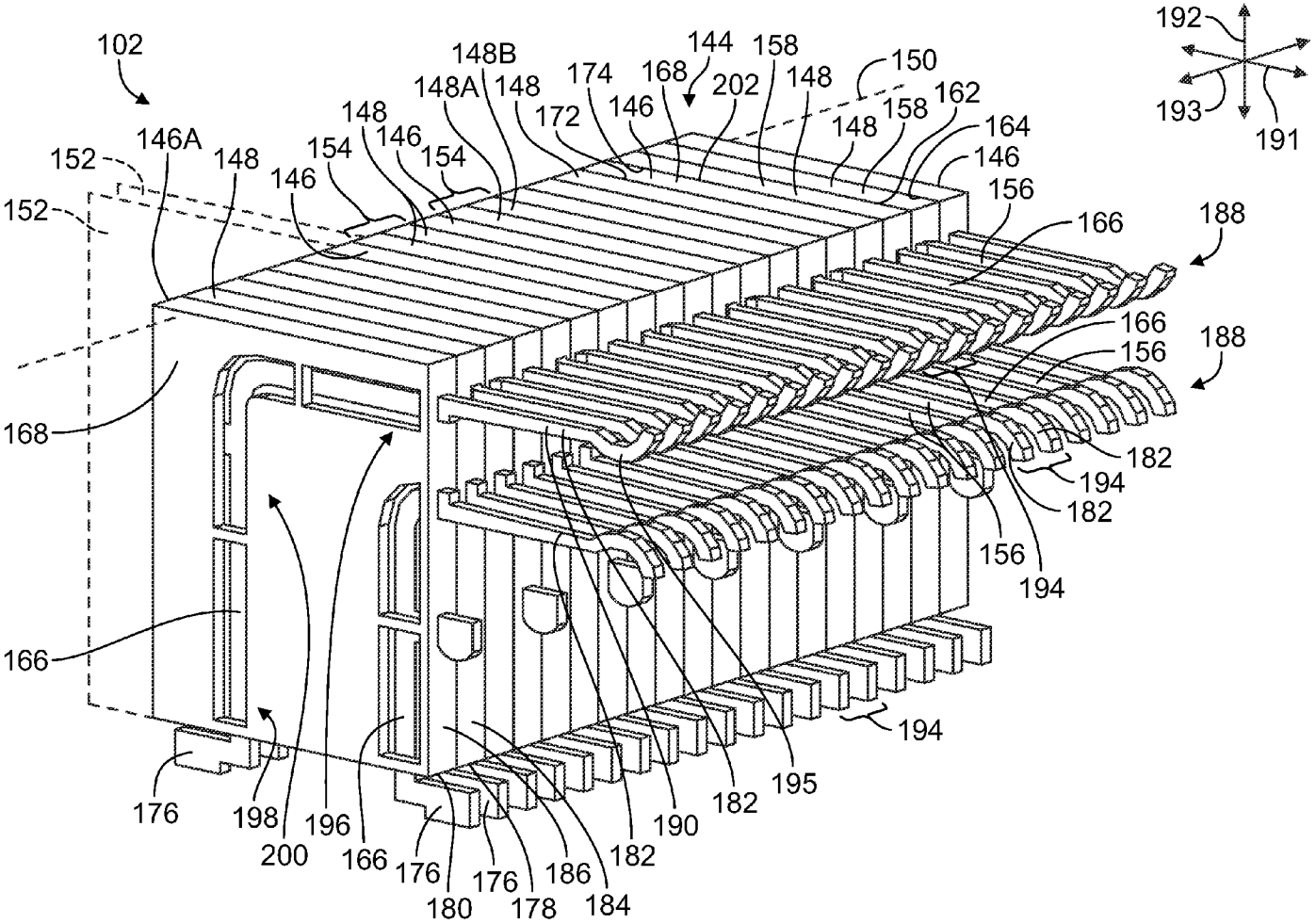
FIG. 2 is a perspective view of an electrical connector of the connector system without a housing according to an embodiment.

The electrical connector 102 includes a housing 108 that holds a plurality of signal wafers 148 (shown in FIG. 2) and ground wafers 146 (FIG. 2). The housing 108 has a mounting side 110 and a front side 112. The front side 112 is configured to engage and mate with the mating connector 106. The mounting side 110 is configured to engage an electrical component, which is the circuit board 104 in FIG. 1. In other embodiments, however, the mounting side 110 may engage another electrical component, such as another electrical connector or a communication device that is capable of electrically coupling to the electrical connector 102. The front side 112 includes a front wall 114 and a mating interface 116 that extends forward from the front wall 114 along the longitudinal axis 191. The mating interface 116 is configured to engage the mating connector 106. Although only one mating interface 116 is shown in FIG. 1, the electrical connector 102 in an alternative embodiment may include two or more mating interfaces 116 along the front side 112.

The mating interface 116 of the electrical connector 102 defines a port 118 or opening. The port 118 is open to a mating cavity 120 within the mating interface 116. A plurality of signal conductors 122 and ground conductors 124 of the signal wafers 148 (shown in FIG. 2) and the ground wafers 146 (FIG. 2), respectively, are disposed within the mating cavity 120. The port 118 is sized and shaped to receive the mating connector 106 therethrough. For example, an edge portion 126 of the mating connector 106 is loaded through the port 118 of the mating interface 116 as the mating connector 106 is mated to the electrical connector 102. The edge portion 126 is received within the mating cavity 120 where conductors (not shown) on the circuit card 107 of the mating connector 106 engage and electrically connect to the corresponding signal conductors 122 and ground conductors 124 of the electrical connector 102. The mating connector 106 may include conductors along a top side 128 of the circuit card 107 and conductors along a bottom side 130 of the circuit card 107. The conductors along the top side 128 are configured to engage signal conductors 122 and ground conductors 124 (not shown in FIG. 1) that are disposed along an upper interior wall 132 of the mating cavity 120. The conductors along the bottom side 130 are configured to engage signal conductors 122 and ground conductors 124 that are disposed along a lower interior wall 134 of the mating cavity 120. In an alternative embodiment, the signal conductors 122 and the ground conductors 124 are disposed along the upper interior wall 132 or the lower interior wall 134, but not both.

The front wall 114 of the housing 108 is joined to other walls to define a module cavity (not shown) that receives the signal wafers 148 (shown in FIG. 2) and the ground wafers 146 (FIG. 2). For example, the housing 108 includes a top wall 136, opposing side walls 138, and a back wall 140 that is opposite the front wall 114. As used herein, relative or spatial terms such as "top," "bottom," "upper," "lower," "left," and "right" are only used to distinguish the referenced elements and do not necessarily require particular positions or orientations in the connector system 100 or in the surrounding environment of the connector system 100. The housing 108 may be manufactured from a dielectric material, such as a plastic material, or may be manufactured from an electrically conductive material, such as a metal material. The mounting side 110 of the housing 108 may be at least partially open to allow the ground wafers 146 and signal wafers 148 to protrude from the module cavity to electrically connect to the circuit board 104. For example, the signal conductors 122 and the ground conductors 124 may be terminated to conductive pads (not shown) located along a mounting surface 142 of the circuit board 104 via soldering or another surface-mounting process. Alternatively, the signal conductors 122 and the ground conductors 124 may have pins (not shown) that are thru-hole mounted into corresponding conductive vias (not shown) defined along the mounting surface 142.

FIG. 2 is a perspective view of the electrical connector 102 without the housing 108 (shown in FIG. 1) according to an embodiment. The electrical connector 102 includes a wafer stack 144 that is held within the housing 108. The wafer stack 144 includes a plurality of ground wafers 146 and signal wafers 148 stacked next to one another along a stack axis 150. The stack axis 150 is parallel to the lateral axis 193. The ground wafers 146 and the signal wafers 148 may be stacked side by side, such that sides of adjacent wafers 146, 148 abut or engage. Each ground wafer 146 and signal wafer 148 may extend along a respective wafer plane 152. The wafer planes 152 of the ground wafers 146 and the signal wafers 148 may be parallel to one another. For example, the wafer planes 152 may be parallel to the longitudinal axis 191. The wafer planes 152 may be perpendicular to the stack axis 150.

In an embodiment, the signal wafers 148 are stacked in pairs 154. Each pair 154 includes two signal wafers 148 that are adjacent to one another. As used herein, "adjacent signal wafers" means first and second signal wafers 148 that do not have any other signal wafers 148 or ground wafers 146 positioned between the first and second signal wafers 148. The ground wafers 146 in an embodiment are interleaved between adjacent pairs 154 of signal wafers 148. As used herein, "adjacent pairs of signal wafers" means first and second pairs 154 of signal wafers 148 that do not have any other signal wafers 148 positioned between the first and second pairs 154, although at least one ground wafer 146 may be disposed between the first and second pairs 154. In the illustrated embodiment, the ground wafers 146 and the signal wafers 148 are stacked in a repeating ground-signal-signal-ground-signal-signal sequence, such that each pair 154 of signal wafers 148 is bordered on both sides by a ground wafer 146. A single ground wafer 146 is disposed between adjacent pairs 154 of signal wafers 148 in the illustrated embodiment, but in other embodiments two or more ground wafers 146 may be disposed between two adjacent pairs 154 of signal wafers 148.

Figure 7:
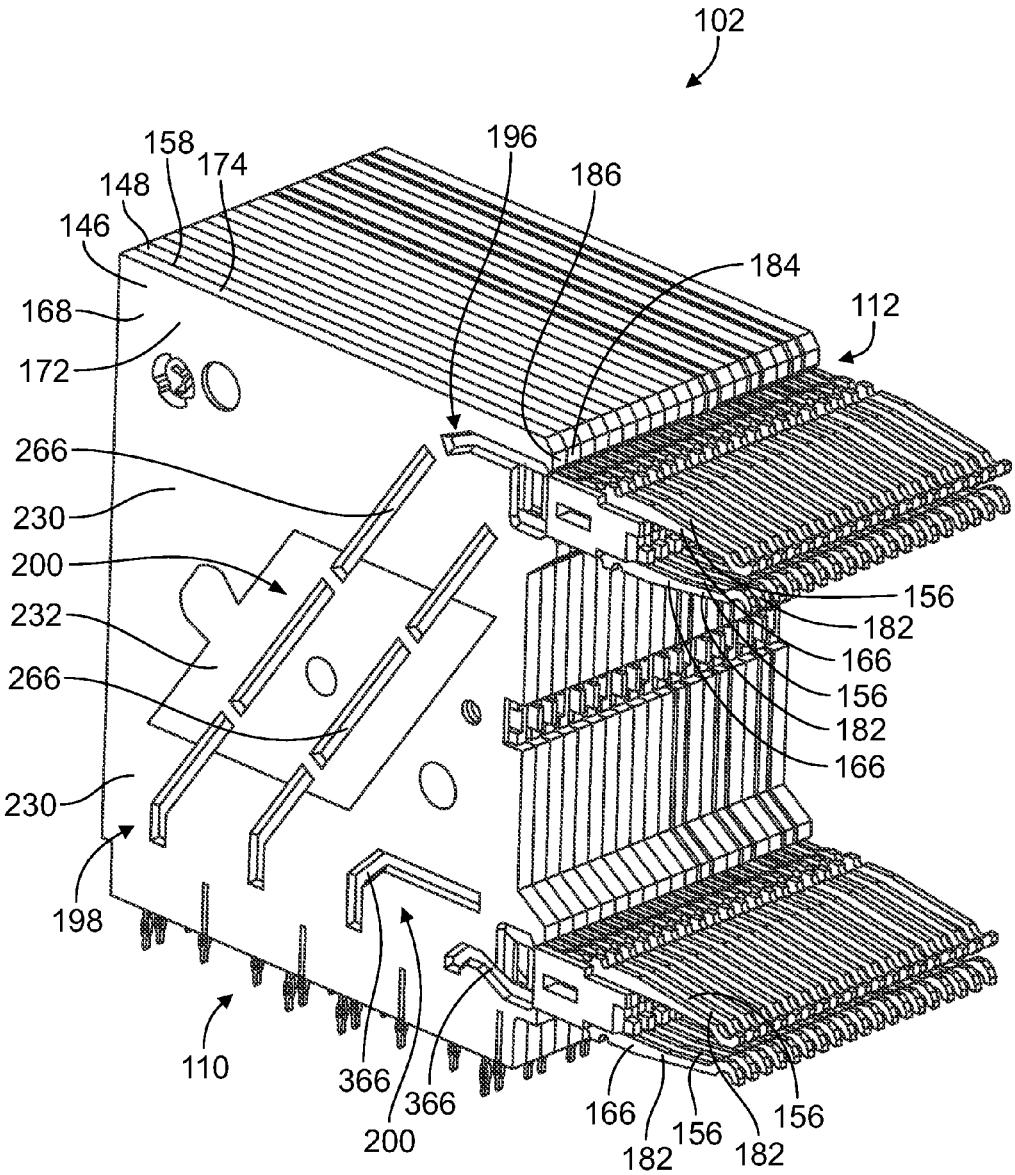
FIG. 7 is a perspective view of the electrical connector shown in FIG. 6 without a housing according to an embodiment.

Each signal wafer 148 includes at least one signal conductor 156 held by a signal holder 158. The signal holder 158 is composed of a first material. The first material is a low loss dielectric material. The term "low loss dielectric material" as used herein is a relative term that means that the first material of the signal holder 158 has a loss tangent that is lower or less than a loss tangent of an electrically and/or magnetically lossy material, as described in more detail herein. Each signal holder 158 includes a left side 162 and an opposite right side 164. The left and right sides 162, 164 face the adjacent wafers 146 and/or 148 on either side of the respective signal wafer 148. At least one signal conductor 156 is held between the left side 162 and the right side 164 of the signal holder 158. Each signal wafer 148 in the illustrated embodiment includes two signal conductors 156 within the respective signal holder 158. But, in other embodiments, at least some signal holders 158 may hold only one or more than two signal conductors 156 (such as four as shown in FIG. 7). The signal conductors 156 in each signal wafer 148 align in a column that extends parallel to the wafer plane 152 of the signal wafer 148. Optionally, the signal holders 158 may be overmolded onto the signal conductors 156 to form the signal wafers 148.

Each ground wafer 146 includes at least one ground conductor 166 held by a ground holder 168. The ground holder 168 is composed of a second material (as compared to the first material of the signal holders 158). The second material is an electrically and/or magnetically lossy material, referred to herein as "lossy material". The lossy material has a loss tangent that is greater or higher than a loss tangent of the low loss dielectric material of the signal holders 158. Each ground holder 168 includes a left side 172 and an opposite right side 174. The left and right sides 172, 174 face the adjacent wafers 146 and/or 148 on either side of the respective ground wafer 146. In the illustrated embodiment, the left and right sides 172, 174 of each ground holder 168 of ground wafers 146 at intermediate locations within the wafer stack 144 each face signal wafers 148. Optionally, the ground holder 168 of each ground wafer 146 abuts the signal holder 158 of an adjacent signal wafer 148 along a seam 202. For example, the ground wafers 146 and signal wafers 148 of the wafer stack 144 may abut one another, defining seams 202 at the interfaces between the engaging holders 158, 168. The seams 202 may extend parallel to the longitudinal axis 191. At least one ground conductor 166 is held between the left side 172 and the right side 174 of the ground holder 168. Each ground wafer 146 in the illustrated embodiment includes two ground conductors 166, but at least some ground wafers 146 may include one or more than two conductors 166 in other embodiments. The ground conductors 166 in each ground wafer 146 align in a column that extends parallel to the wafer plane 152 of the ground wafer 146. In an embodiment, the ground holders 168 are overmolded onto the ground conductors 166 to form the ground wafers 146.

The signal conductors 156 and the ground conductors 166 are each configured to engage and electrically connect to the mating connector 106 (shown in FIG. 1) and an electrical component, such as the host circuit board 104 (shown in FIG. 1). Thus, the signal conductors 156 and the ground conductors 166 each provide an electrical current path between the mating connector 106 and the electrical component. For example, the signal and ground conductors 156, 166 are terminated to the circuit board 104 and are configured to engage the mating connector 106 when the mating connector 106 is loaded into the port 118 (shown in FIG. 1) of the electrical connector 102. The signal and ground conductors 156, 166 each include a mounting contact 176 that terminates to the host circuit board 104. The mounting contacts 176 of the signal conductors 156 protrude from a mounting edge surface 178 of the respective signal holders 158. The mounting contacts 176 of the ground conductors 166 protrude from a mounting edge surface 180 of the respective ground holders 168. In the illustrated embodiment, the mounting contacts 176 are configured to be surface-mounted (by soldering, for example) to conductive pads on the circuit board 104. In an alternative embodiment, the mounting contacts 176 may be pin contacts, such as compliant eye-of-the-needle-type contacts, which facilitate press-fit termination of the electrical connector 102 to the host circuit board 104 via thru-hole mounting.

The signal conductors 156 and the ground conductors 166 each include a mating contact 182 that is configured to engage the mating connector 106 (shown in FIG. 1). The mating contacts 182 of the signal conductors 156 protrude from a front edge surface 184 of the respective signal holder 158. The mating contacts 182 of the ground conductors 166 protrude from a front edge surface 186 of the respective ground holder 168. The mating contacts 182 of the signal and ground conductors 156, 166 extend generally forward (along the longitudinal axis 191) into the port 118 (shown in FIG. 1) of the electrical connector 102. In an embodiment, the mating contacts 182 are configured to mechanically and electrically engage contact pads on the circuit card 107 (shown in FIG. 1) of the mating connector 106. The mating contacts 182 may include an elongated arm 190 and a mating tip 195 at a distal end of the arm 190. The mating tip 195 is configured to engage the corresponding contact pad. The arm 190 may be configured to at least partially deflect as the mating tip 195 engages the contact pad to provide a biasing force that retains the mechanical and electrical connection between the mating contact 182 and the circuit card 107.

In the illustrated embodiment, each wafer 146, 148 includes two mating contacts 182, and the two mating contacts 182 of each wafer 146, 148 align in a column along the elevation axis 192. Across the wafer stack 144, the mating contacts 182 of the plurality of wafers 146, 148 align in lateral rows 188 that extend parallel to the stack axis 150. In the illustrated embodiment, the wafer stack 144 includes two rows 188 of mating contacts 182. Both rows 188 of mating contacts 182 are configured to be received in the mating interface 116 (shown in FIG. 1) of the housing 108 (FIG. 1). For example, one of the rows 188 defines an upper row that extends along the upper interior wall 132 (shown in FIG. 1) of the mating cavity 120 (FIG. 1), and the other row 188 defines a lower row that extends along the lower interior wall 134 (FIG. 1) of the mating cavity 120. Alternatively, only a single row 188 of mating contacts 182 may extend into each mating interface 116 of the housing 108. In other embodiments, the housing 108 may include more than one mating interface 116, and the rows 188 of mating contacts 182 may extend into different mating interfaces 116 for connecting to different mating connectors 106 (shown in FIG. 1).

In an embodiment, the signal conductors 156 of each pair 154 of signal wafers 148 are arranged as differential signal pairs 194 that transmit differential signals. Each differential signal pair 194 is defined by one signal conductor 156 of a first signal wafer 148A of the pair 154 and one signal conductor 156 of a second signal wafer 148B of the pair 154. The signal conductors 156 of each differential signal pair 194 have adjacent mating contacts 182 that align in the same row 188 of mating contacts 182. For example, in the illustrated embodiment, each pair 154 of signal wafers 148 defines two differential signal pairs 194. Each of the two signal conductors 156 of each signal wafer 148 forms half of a different one of the two differential signal pairs 194.

Figure 3:
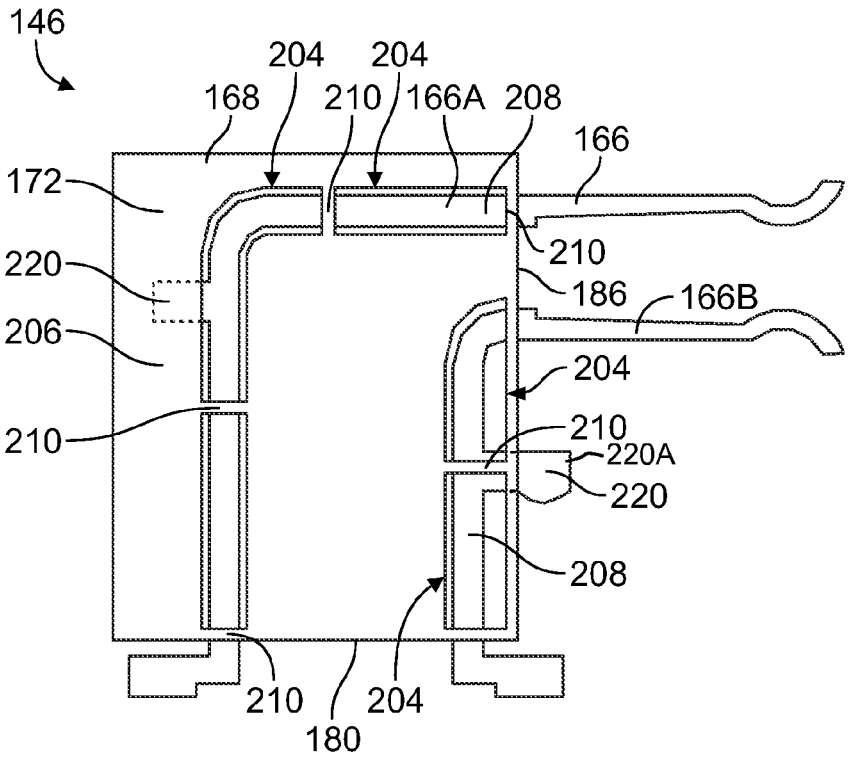
FIG. 3 is a left side view of a ground wafer of the electrical connector according to an embodiment.
Figure 4:
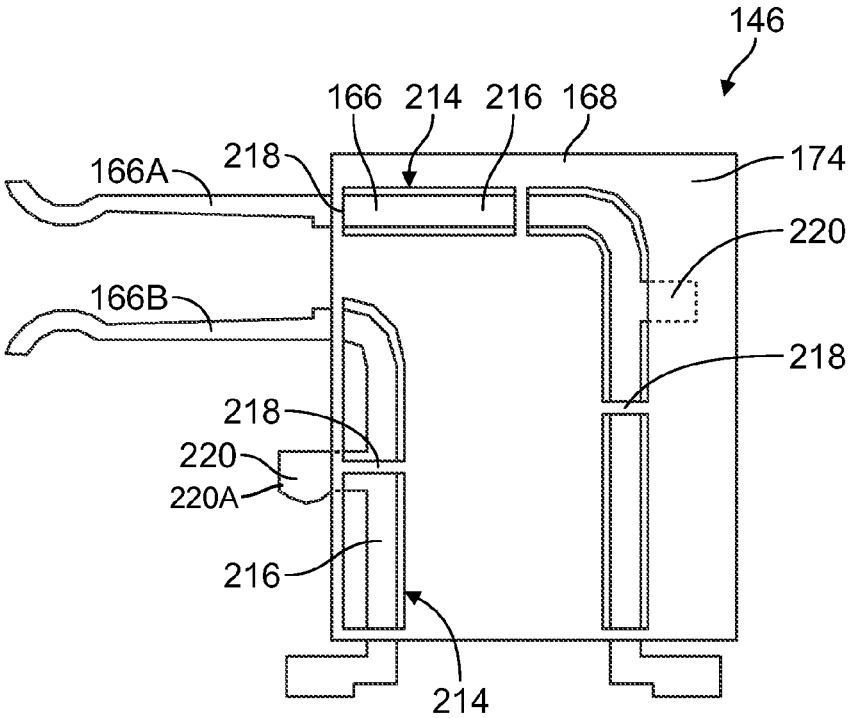
FIG. 4 is a right side view of the ground wafer shown in FIG. 3.

The signal conductors 156 and the ground conductors 166 extend through the respective signal holders 158 and ground holders 168 between the mating contacts 182 and the mounting contacts 176. For example, the ground conductors 166 each include a mating segment 196, a terminating segment 198, and an intermediate segment 200 therebetween. The mating segment 196 includes the mating contact 182 and may extend into the ground holder 168 through the front edge surface 186. The terminating segment 198 includes the mounting contact 176 and may extend into the ground holder 168 through the mounting edge surface 180. The intermediate segment 200 links the mating segment 196 and the terminating segment 198. The intermediate segment 200 may be held completely within ground holder 168 (except possibly for protrusions or extensions that extend from the intermediate segment 200 for use in holding the ground conductors 166 within the ground holder 168, as shown in FIGS. 3 and 4). The intermediate segments 200 may include one or more curves. Although only the ground conductors 166 of an end ground wafer 146A are shown in FIG. 2, the signal conductors 156 of the signal wafers 148 may also include mating segments, terminating segments, and intermediate segments that generally follow a parallel course to the ground conductors 166 of the adjacent ground wafers 146. In an embodiment, the ground conductors 166 are generally disposed between the signal conductors 156 of adjacent pairs 154 of signal wafers 148. The ground conductors 166 provide shielding between the adjacent pairs 154 of signal wafers 148 in order to reduce crosstalk that degrades electrical performance, as well as to provide a reliable ground return path.

During operation of the electrical connector 102, electrical energy (for example, current and voltage) may exist between the ground conductors 166. For example, as the electrical energy propagates through the signal conductors 156 between the corresponding mating contacts 182 and mounting contacts 176 of the signal conductors 156, the ground conductors 166 may support electrical energy that radiates from the signal conductors 156. The ground conductors 166 and the space between grounding elements of the host circuit board 104 (shown in FIG. 1) and grounding elements of the mating connector 106 (FIG. 1) can form a resonant cavity. As electrical energy propagates within the resonant cavity, reflections between the circuit board 104 and the mating connector 106 can occur and be supported by (surfaces of) the ground conductors 166. Without controlling the resonance, such reflections may form a standing wave (or resonating condition) at certain frequencies. The standing wave (or resonating condition) may cause electrical noise that, in turn, may increase insertion loss and/or crosstalk and reduce throughput of the electrical connector 102.

In an embodiment, the lossy material of the ground holders 168 of the ground wafers 146 is configured to impede the development of these standing waves (or resonating conditions) at certain frequencies and, consequently, reduce the unwanted effects of the electrical noise. For example, the lossy material of the ground holders 168 may absorb some of the electrical energy that propagates through the corresponding ground cavity along the at least one ground conductor 166 held by each ground holder 168. The lossy material may dissipate the absorbed electrical energy as heat. The lossy material in some embodiments may effectively change or dampen the reflections such that the standing wave (or the resonating condition) is not formed during operation of the electrical connector 102.

The lossy material of the ground holders 168 is able to conduct electrical energy, but with at least some loss. The "loss" as used herein refers to dielectric loss, which is a dielectric material's inherent dissipation of electromagnetic energy into, for example, heat. The lossy material is less conductive than the ground conductor(s) 166 held by the ground holder 168. For example, the signal and ground conductors 156, 166 may be stamped and formed from a copper alloy or other suitable metal that is capable of transmitting data signals at a commercially desirable data rate. The lossy material of the ground holders 168 is less conductive than the material that forms the signal and ground conductors 156, 166. The lossy material of the ground holders 168, on the other hand, is more conductive, and has greater dielectric loss, than the low loss dielectric material of the signal holders 158.

In an embodiment, the lossy material of the ground holders 168 includes conductive particles dispersed within a dielectric material. The conductive particles may be filler elements (or fillers) and the dielectric material may be a binder that is used to hold the conductive particles in place. As used herein, the term "binder" encompasses a material that encapsulates a filler or is impregnated with a filler. The conductive particles impart increased loss to the overall lossy material. For example, the lossy material of the ground holders 168 is more conductive, and has greater dielectric loss, than the low loss dielectric material of the signal holders 158.

The frequency range of interest may depend on the operating parameters of the connector system in which the electrical connector 102 is used. For example, the frequency range of interest, for some embodiments, may be between direct current (DC) and 50 GHz, but it should be understood that higher frequencies may be of interest in other embodiments. Some electrical connectors or connector systems may have frequency ranges that span only a limited portion of the above range, such as between DC and 20 GHz. In some embodiments, the electrical connector 102 may be configured for broadband data transmission. As used herein, the "electric loss tangent" is a ratio of an imaginary part to a real part of a complex electrical permittivity of the material of interest. Examples of electrically lossy materials that may be used are those that have an electric loss tangent between approximately 0.5 and 10.0 over the frequency range of interest. As used herein, the "magnetic loss tangent" is a ratio of an imaginary part to a real part of a complex magnetic permeability of the material of interest. Examples of magnetically lossy materials that may be used are those that have a magnetic loss tangent above 0.5 over the frequency range of interest.

The lossy material of the ground holders 168 may include material that is generally thought of as conductive, but is either a relatively poor conductor over the frequency range of interest, contains particles that are sufficiently dispersed in a dielectric such that the particles do not provide a high conductivity, or is otherwise prepared with properties that lead to a relatively weak bulk conductivity over the frequency range of interest. The lossy material may be partially conductive, such as having a bulk conductivity of between 5 Siemens per meter and 50 Siemens per meter.

As described above, the lossy material of the ground holders 168 may be formed by mixing a binder with a filler that includes conductive particles. The conductive particles used as fillers may include carbon and/or graphite formed as fibers, flakes, or other particles. Metal in the form of powder, flakes, fibers, or other conductive particles may be used as the filler in addition to, or as an alternative to, the carbon and/or graphite to provide suitable electrically lossy properties. Combinations of fillers may be used in some embodiments, such as metal plated (or coated) particles. Silver and nickel may be used to plate particles. Plated (or coated) particles may be used alone or in combination with other fillers, such as carbon flakes. The filler particles may be present in a sufficient volume percentage to allow conducting paths to be created from particle to particle. For example, when metal fibers are used, the fibers may be present in up to 40% by volume or more.

The binder material may be any material that will set, cure, or can otherwise be used to position the filler material. The binder may be a thermoplastic material, such as a liquid crystal polymer. The thermoplastic material may facilitate the molding of the lossy material into the desired shapes of the ground holders 168 as part of the manufacture of the electrical connector 102. However, many alternative forms of binder materials may be used. For example, epoxies, thermosetting resins, and/or adhesives may be used as binder materials.

The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles.

As described above the low loss dielectric material of the signal holders 158 has a loss tangent that is lower than a loss tangent of the lossy material of the ground holders 168. The "loss tangent" refers to electric loss tangent. The loss tangent optionally may also refer to magnetic loss tangent. For example, the low loss dielectric material may have a loss tangent in the range of 0.001 to 0.1. More specifically, the loss tangent of the low loss dielectric material may be in the range of 0.005-0.01, such as 0.008 for example. The lossy material, on the other hand, may have a loss tangent that is higher or greater, such as in the range of 0.1 to 10.0. More specifically, the loss tangent of the lossy material may be in the range of 0.3-3.0, such as 0.5 for example. In an embodiment, the loss tangent of the low loss dielectric material is no more than one-tenth of the loss tangent of the lossy material (such that the loss tangent of the lossy material is at least ten times greater than the loss tangent of the low loss dielectric material). In some embodiments, the loss tangent of the low loss dielectric material may be closer to one-hundredth (for example, 0.01 versus 1.0) of the loss tangent of the lossy material. Thus, the lossy material of the ground holders 168 may absorb significantly more electrical energy than the low loss dielectric material of the signal holders 158.

As described below, in an alternative embodiment, at least some of the ground holders 168 may include both the lossy material and a low loss dielectric material, such that a first portion of the ground holder 168 is composed of the lossy material and a second portion is composed of the low loss dielectric material. The low loss dielectric material of these ground holders 168 may be the same material as the low loss dielectric material of the signal holders 158, or may be a different low loss dielectric material.

FIG. 3 is a left side view of a ground wafer 146 according to an embodiment. FIG. 4 is a right side view of the ground wafer 146 of FIG. 3. FIG. 3 shows the left side 172 of the ground holder 168, and FIG. 4 shows the right side 174 of the ground holder 168.

Referring to FIG. 3, the ground holder 168 defines windows 204 in the left side 172. The windows 204 are recessed regions of the ground holder 168 that are recessed from a surface 206 of the ground holder 168 along the left side 172. The windows 204 align generally with the ground conductors 166 held by the ground holder 168. Each window 204 exposes at least a portion of one of the ground conductors 166. For example, the portion of the ground conductor 166 that aligns with one window 204 is exposed to the air and surrounding environment of the ground wafer 146. In an embodiment, the exposed portions of the ground conductors 166 are left broad sides 208 of the ground conductors 166 extending along various lengths of the conductors 166. For example, the lossy material of the ground holder 168 does not engage the left broad side 208 of each ground conductor 166 along the exposed portions that align with the windows 204. The windows 204 align with the ground conductors 166 such that one or more windows 204 align with a first ground conductor 166A and one or more other windows 204 align with a second ground conductor 166B. In an embodiment, the ground holder 168 defines ribs 210 along the left side 172. The ribs 210 extend between two adjacent windows 204. Ribs 210 also may extend between the front edge surface 186 of the ground holder 168 and the window(s) 204 most proximate to the front edge surface 186 and between the mounting edge surface 180 and the window(s) 204 most proximate to the mounting edge surface 180. The ribs 210 are configured to engage the left broad sides 208 of the corresponding ground conductors 166 to hold the ground conductors 166 in place between the left side 172 and the right side 174 (FIG. 4) of the ground holder 168. For example, the ribs 210 may be used to laterally support the ground conductors 166, as the windows 204 may not provide lateral support to hold the ground conductors 166 within the ground holder 168.

Referring now to FIG. 4, the ground holder 168 also defines windows 214 in the right side 174. The windows 214 may be similar to the windows 204 defined along the left side 172 of the ground holder 168 as shown in FIG. 3. For example, the windows 214 align with the ground conductors 166 to expose a right broad side 216 of a corresponding ground conductor 166 along at least a portion of the ground conductor 166. The windows 214 may align generally with the windows 204 along the left side 172. The right side 174 of the ground holder 168 also may define ribs 218 that are configured to engage the right broad sides 216 of the ground conductors 166 to hold the ground conductors 166 laterally within the ground holder 168.

Referring now to both FIGS. 3 and 4, in an embodiment the ground wafer 146 is formed by applying the material of the ground holder 168 onto the ground conductors 166. For example, the lossy material of the ground holder 168 may be molded (for example, overmolded) onto the pre-formed ground conductors 166 within a mold. The mold may define the shape of the ground holder 168. The windows 204, 214 may be formed via pins added into the mold prior to injecting the lossy material, or by cutting or stamping the ground holder 168 in a subsequent stage of the molding process or after the molding process. In other embodiments, the lossy material of the ground holder 168 may be coated onto the intervening ground conductors 166 via painting, dipping, electroplating, or the like, or by using a conductive adhesive. The conductors 166 may include protrusions 220 that extend from the conductors 166. The protrusions 220 are at least partially covered by the lossy material, such that portions of the protrusions 220 are disposed under a layer of lossy material and are shown in phantom in FIGS. 3 and 4. The protrusions 220 may be used to increase the contact area between the conductors 166 and the ground holder 168, which supports the mechanical stability of the ground wafer 146. In the illustrated embodiments shown in FIGS. 3 and 4, the protrusion 220A extending from the second ground conductor 166B protrudes from the lossy material of the ground holder 168 and is used as a retention feature for securing the ground holder 168 to the connector housing 108 (shown in FIG. 1).

In the illustrated embodiment shown in FIGS. 3 and 4, the ground holder 168 of the ground wafer 146 is formed entirely of the lossy material. In an alternative embodiment, however, at least a portion of the ground holder 168 may be formed of a low loss dielectric material. For example, the first ground conductor 166A is longer than the second ground conductor 166B in the illustrated embodiment. Therefore, the first ground conductor 166A extends through a greater length of the lossy material than the second ground conductor 166B. Due to the lossy material, more electrical energy may be absorbed from the first ground conductor 166A than from the second ground conductor 166B within the ground holder 168, such that the first ground conductor 166A experiences more loss than the second ground conductor 166B. Optionally, at least a portion of the ground holder 168 is formed of a low loss dielectric material, and the first ground conductor 166A extends through the portion formed of the low loss dielectric material. The second ground conductor 166B either does not extend through the portion of the low loss dielectric material at all, or extends through a reduced amount of the low loss dielectric material relative to the amount of the low loss dielectric material that the first ground conductor 166A extends through. Since the first conductor 166A extends through more low loss dielectric material than the second conductor 166B, the first conductor 166A experiences less energy loss per unit length than the second conductor 166B. Thus, the loss through the first, longer ground conductor 166A may be reduced to a level or value that is closer to the loss through the second, shorter ground conductor 166B by forming at least a portion of the ground holder 168 out of a low loss dielectric material.

Figure 5:
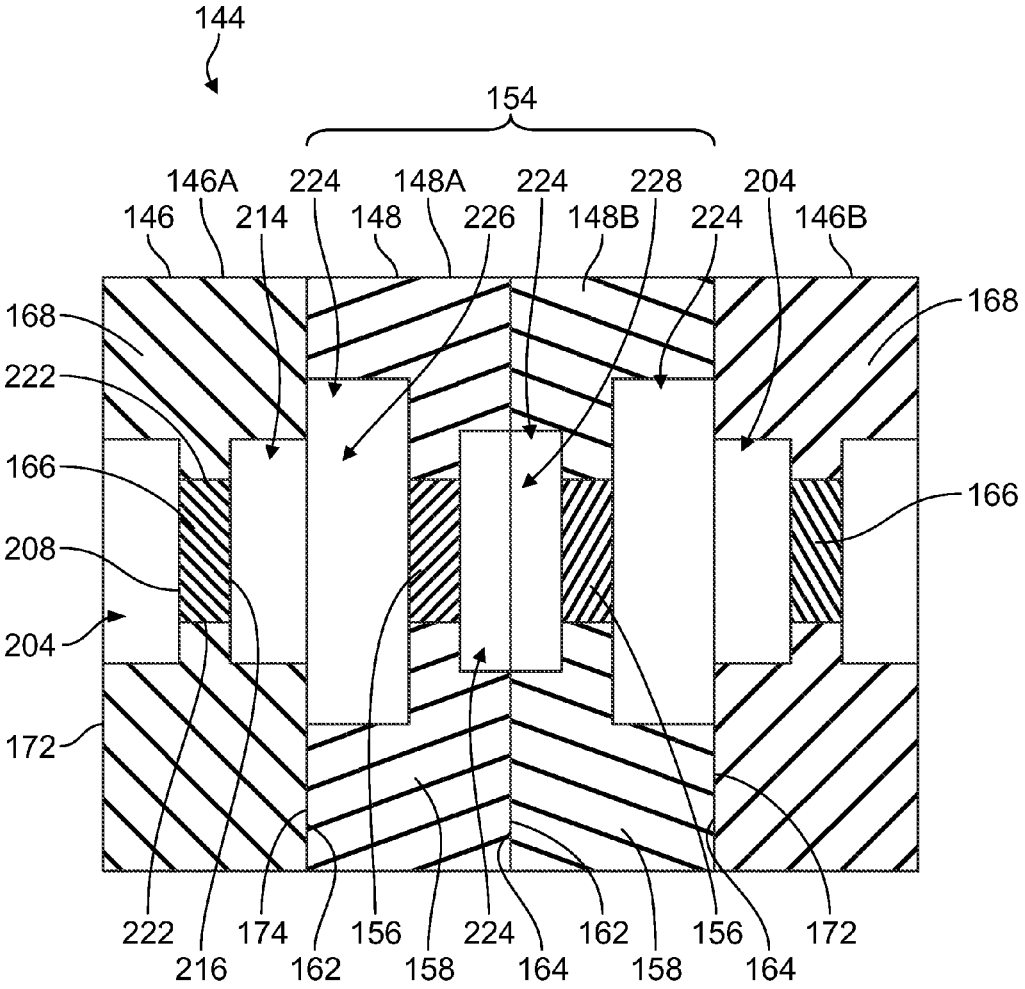
FIG. 5 is a cross-sectional view of a portion of a wafer stack of the electrical connector according to an embodiment.

FIG. 5 is a cross-sectional view of a portion of the wafer stack 144 of the electrical connector 102 shown in FIG. 2. The illustrated portion of the wafer stack 144 includes a pair 154 of two signal wafers 148 and one ground wafer 146 disposed along each side of the pair 154 (for a total of two ground wafers 146). The visible section of each of the ground wafers 146 includes one ground conductor 166 held by the ground holder 168. Similarly, the visible section of each of the signal wafers 148 includes one signal conductor 156 held by the signal holder 158.

The ground conductors 166 each include the left and right broad sides 208, 216 and two edge sides 222. The edge sides 222 each extend between the left and right broad sides 208, 216. The edge sides 222 are narrower than the broad sides 208, 216. In an embodiment, the ground holder 168 of each ground wafer 146 engages both edge sides 222 along at least a majority of the length of the respective ground conductor 166 (as shown in the side views in FIGS. 3 and 4). In addition, the ground holder 168 engages the broad sides 208, 216 along a minority of the length of the respective ground conductor 166. In the cross-section shown in FIG. 5, the lossy material of the ground holder 168 engages the edge sides 222 but not the broad sides 208, 216. But, the lossy material may engage the broad sides 208, 216 at other locations along the length of the ground conductor 166, such as the locations of the ribs 210, 218 (shown in FIGS. 3 and 4, respectively). In FIG. 5, the left broad side 208 of each ground conductor 166 is exposed through a corresponding window 204 along the left side 172 of the ground holder 168, and the right broad side 216 is exposed through a corresponding window 214 along the right side 174 of the ground holder 168.

Like the ground holders 168, the signal holders 158 of the signal wafers 148 may define windows 224 along the left side 162 and the right side 164. The windows 224 may align with the signal conductors 156 such that each window 224 exposes at least a portion of one of the signal conductors 156 through the window 224. The sizes of the windows 224 may be selected or modified in order to tune the impedance of the electrical connector 102 (shown in FIG. 2). In an embodiment, the windows 224 along the left side 162 of a first signal wafer 148A of the pair 154 align generally with the windows 214 along the right side 174 of an adjacent ground wafer 146A to the left. The left side 162 of the signal holder 158 may abut the right side 174 of the ground holder 168. The windows 224, 214 align and provide a cavity 226 between the ground conductor 166 and the signal conductor 156 such that the signal and ground conductors 156, 166 are exposed to one another. The cavity 226 may be filled with air. In addition, the windows 224 along the right side 164 of the first signal wafer 148A may align generally with the windows 224 along the left side 162 of the second signal wafer 148A in the pair 154. The windows 224 of the first and second signal wafers 148A, 148B may combine to define a cavity 228 between the respective signal conductors 156, such that the signal conductors 156 of the first signal wafer 148A are exposed to corresponding signal conductors 156 of the second signal wafer 148B. Windows 224 along the right side 164 of the second signal wafer 148B may likewise align with the windows 204 along the left side 172 of the adjacent ground wafer 146B to expose the signal conductors 156 of the second signal wafer 148B to the ground conductors 166 of the adjacent ground wafer 146B.

Figure 6:
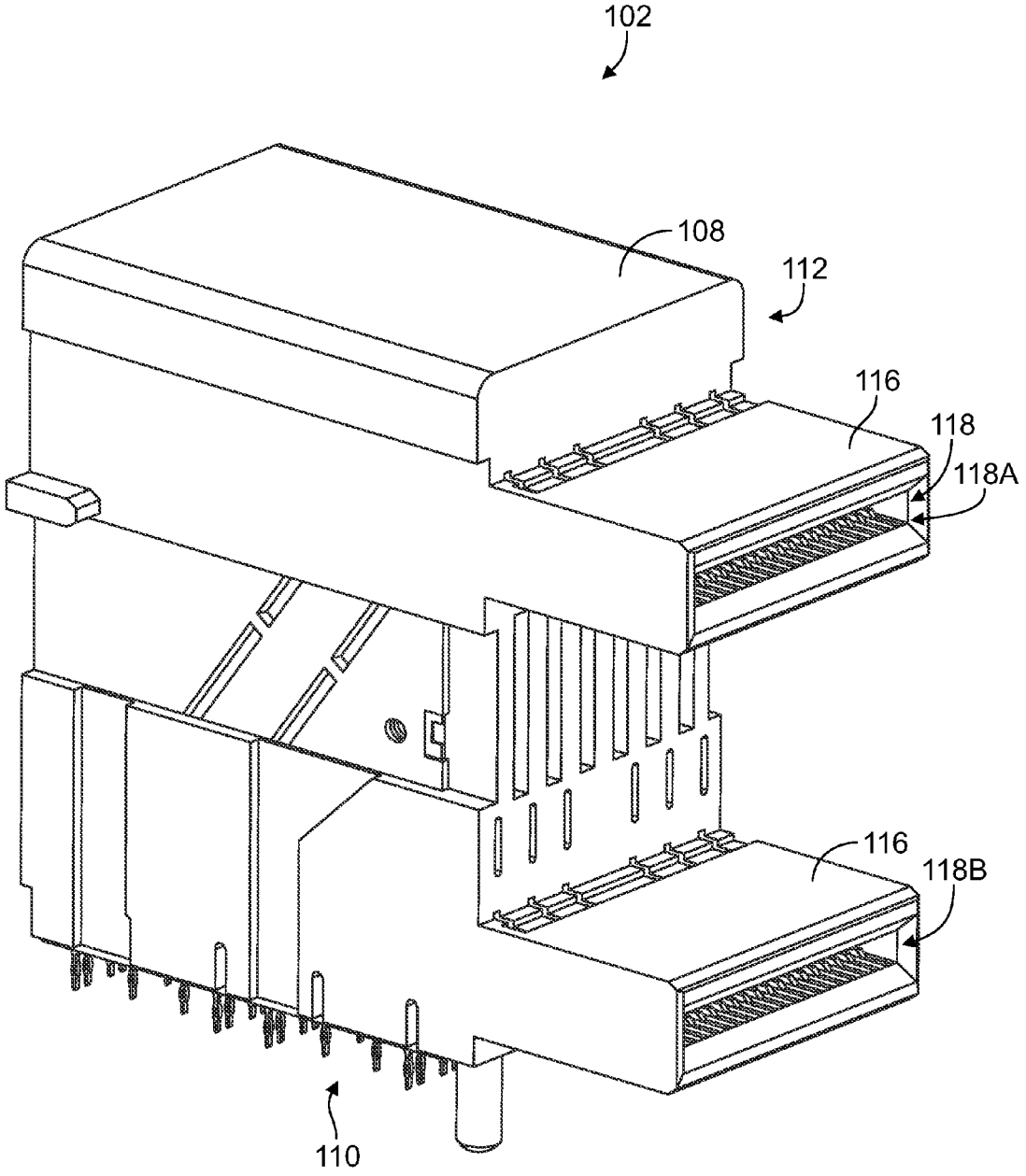
FIG. 6 is perspective embodiment of the electrical connector according to an alternative embodiment.

FIG. 6 is perspective embodiment of the electrical connector 102 according to an alternative embodiment. In contrast to the embodiment of the electrical connector 102 shown in FIG. 1, the front side 112 of the housing 108 in FIG. 6 includes two mating interfaces 116 defining two ports 118. The ports 118 are stacked vertically to define an upper port 118A and a lower port 118B. The lower port 118B is more proximate to the mounting side 110 than the distance between the upper port 118A and the mounting side 110. The upper port 118A and the lower port 118B are configured to receive a circuit card 107 (shown in FIG. 1) of different mating connectors 106 (FIG. 1) therein.

FIG. 7 is a perspective view of the electrical connector 102 shown in FIG. 6 without the housing 108 (FIG. 6) according to an embodiment. The ground wafers 146 each include at least two ground conductors 166, and the signal wafers 148 each include at least two signal conductors 156. The signal conductors 156 and the ground conductors 166 are configured to engage respective contacts of the mating connector 106 (shown in FIG. 1). For example, at least one signal conductor 156 of each signal wafer 148 includes a mating contact 182 that extends from the front edge surface 184 of the signal holder 158 into the upper port 118A (shown in FIG. 6), and at least another signal conductor 156 of the same signal wafer 148 includes a mating contact 182 that extends into the lower port 118B (FIG. 6). Each signal wafer 148 includes four signal conductors 156 in the illustrated embodiment. The signal holders 158 are formed of a low loss dielectric material.

Similarly, the ground wafers 146 each include at least one ground conductor 166 with a mating contact 182 that extends from the front edge surface 186 into the upper port 118A and at least one ground conductor 166 with a mating contact 182 that extends into the lower port 118B. The at least one ground conductor 166 of each ground wafer 146 that extends from the mounting side 110 to the upper port 118A is referred to as a long ground conductor 266, and the at least one ground conductor 166 of each ground wafer 146 that extends from the mounting side 110 to the lower port 118B is referred to as a short ground conductor 366. In the illustrated embodiment, each ground wafer 146 includes four ground conductors 166 comprised of two long ground conductors 266 and two short ground conductors 366. The long ground conductors 266 are each longer than each of the short ground conductors 366.

In the illustrated embodiment, the ground holders 168 of the ground wafers 146 are composed of different materials along different portions of the ground holders 168. For example, a first portion 230 of the ground holder 168 is composed of the lossy material, and a second portion 232 of the ground holder 168 is composed of a low loss dielectric material. The low loss dielectric material of the second portion 232 may be the same or a different type of material than the low loss dielectric material of the signal holders 158. The low loss dielectric materials of the signal holders 158 and of the second portions 232 of the ground holders 168 both have a respective loss tangent that is lower than the loss tangent of the lossy material of the first portion 230 of the ground holders 168. For example, the low loss dielectric material of the signal holder 158 and the low loss dielectric material of the second portion 232 of the ground holders 168 may each have a loss tangent that is no more than one-tenth of the loss tangent of the lossy material of the first portion 230 of the ground holders 168.

Optionally, the lossy material of the first portion 230 of each ground holder 168 is not coated on the low loss dielectric layer of the second portion 232, or vice-versa. For example, the ground holders 168 each extend between the left side 172 and the right side 174. The left and right sides 172, 174 of the ground holder 168 along the first portion 230 are both defined by the lossy material, without any low loss dielectric material therebetween. Along the second portion 232, the left and right sides 172, 174 of the ground holder 168 are both defined by the low loss dielectric material, without any lossy material therebetween. In an embodiment, the ground wafers 146 may be formed by a two-shot overmold process in which the first portion 230 of the ground holders 168 is formed over the ground conductors 166 prior to the second portion 232, or vice versa.

In the illustrated embodiment, the intermediate segments 200 of the long ground conductors 266 extend through both the first portion 230 and the second portion 232 of the respective ground holder 168. The intermediate segments 200 of the short ground conductors 366, on the other hand, only extend through the first portion 230 of the respective ground holder 168. For example, as shown in FIG. 7, the mating segment 196 and an upper length of the intermediate segment 200 of each long ground conductor 266 may extend through the first portion 230 of the ground holder 168. In addition, the terminating segment 198 and a lower length of the intermediate segment 200 of each long ground conductor 266 also extend through the first portion 230, while a middle length of the intermediate segment 200 of each long ground conductor 266 extends through the second portion 232. Thus, in the illustrated embodiment, the long ground conductors 266 may engage both the lossy material and the low loss dielectric material along the lengths of the long ground conductors 266, while the short ground conductors 366 may engage only the lossy material along the lengths of the short ground conductors 366.

The low loss dielectric material of the second portion 232 is configured to engage the long ground conductors 266 to a greater degree or extent than the short ground conductors 366 due to the fact that the long ground conductors 266 are longer and therefore engage more lossy material between the front side 112 and the mounting side 110 than the short ground conductors 366. As such, the long ground conductors 266 would experience more electrical energy loss than the short ground conductors 366 if the entirety of the each ground holder 168 was formed of lossy material. By extending the long ground conductors 266 through the second portion 232 of low loss dielectric material, the electrical energy loss through the long ground conductors 266 may be reduced such that the long ground conductors 266 have loss characteristics more similar to the loss characteristics of the short ground conductors 366.

In alternative embodiments, the locations, sizes, and proportions of the first and second portions 230, 232 may be altered or tuned. For example, in one alternative embodiment, the ground holders 168 are formed of only the lossy material without a portion of low loss dielectric material. The thickness of the ground holders 168 along the long ground conductors 266 may be reduced relative to the thickness of the same ground holders 168 along the short ground conductors 366 in order to reduce the volume of lossy material that closely surrounds the long ground conductors 266, thereby reducing the electrical energy loss experienced by the long ground conductors 266 relative to the electrical energy loss experienced by the short ground conductors 366. In yet another alternative embodiment, the short ground conductors 366 may also be routed through both the lossy material of the first portion 230 and the low loss dielectric material of the second portion 232, but a greater length of the long ground conductors 266 may be routed through the low loss dielectric material than the length of the short ground conductors 366 that is routed through the low loss dielectric material.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mounting side and a front side, the front side configured to mate with a mating connector; and a plurality of ground wafers and signal wafers stacked next to one another along a stack axis, the signal wafers being stacked in pairs and the ground wafers being interleaved between adjacent pairs of the signal wafers, each signal wafer including multiple signal conductors held by a signal holder that is composed of a low loss dielectric material, each ground wafer including multiple ground conductors held by a ground holder that is composed of a lossy material, the ground wafers lacking signal conductors, the low loss dielectric material having a loss tangent that is lower than a loss tangent of the lossy material, the signal conductors and the ground conductors configured to engage and electrically connect to the mating connector.

2. The electrical connector of claim 1, wherein the ground conductors each provide an electrical current path between the mating connector and an electrical component to which the ground conductors are terminated, the lossy material of each ground holder configured to absorb at least some electrical energy that propagates along the ground conductors held by the respective ground holder.

3. The electrical connector of claim 1, wherein the lossy material of the ground holders includes conductive particles dispersed within a dielectric binder material.

4. The electrical connector of claim 1, wherein the front side of the housing includes a port that is configured to receive a circuit card of the mating connector therein, the signal conductors each having a mating contact extending from a front edge surface of the respective signal holder, the ground conductors each having a mating contact extending from a front edge surface of the respective ground holder, the mating contacts of at least some of the signal conductors and at least some of the ground conductors extending into the port.

5. The electrical connector of claim 1, wherein the low loss dielectric material of the signal holders has a loss tangent that is no more than one-tenth of a loss tangent of the lossy material of the ground holders.

6. The electrical connector of claim 1, wherein the ground holder of each ground wafer abuts the signal holder of an adjacent signal wafer along a seam.

7. The electrical connector of claim 1, wherein each pair of signal wafers defines multiple differential signal pairs, each differential signal pair being defined by one signal conductor of a first signal wafer of the pair and one signal conductor of a second signal wafer of the pair.

8. The electrical connector of claim 1, wherein each ground conductor is held between a left side and an opposite right side of the respective ground holder, the ground holders defining windows in the left side and the right side, the windows aligning with the ground conductors such that each window exposes at least a portion of one of the ground conductors through the window.

9. The electrical connector of claim 8, wherein the ground holder of each ground wafer defines ribs along the left side and along the right side, each rib extending between two adjacent windows and engaging a broad side of a corresponding ground conductor to hold the ground conductor between the left and right sides of the ground holder.

10. The electrical connector of claim 8, wherein each signal conductor is held between a left side and an opposite right side of the respective signal holder, the signal holders defining windows in the left side and the right side, the windows aligning with the signal conductors such that each window exposes at least a portion of one of the signal conductors through the window, wherein the windows along the left side of a first signal wafer align generally with the windows along the right side of an adjacent ground wafer that abuts the first signal wafer such that the signal conductors of the first signal wafer are exposed to the ground conductors of the ground wafer.

11. The electrical connector of claim 1, wherein the ground conductors each include two edge sides and two broad sides, the edge sides being narrower than the broad sides and extending between the two broad sides, the lossy material of the ground holder engaging the edge sides along at least a majority of a length of each of the ground conductors through the ground holder, the lossy material engaging the broad sides along a minority of the length of each of the ground conductors through the ground holder.

12. The electrical connector of claim 1, wherein the front side of the housing includes an upper port and a lower port, each of the upper and lower ports being configured to receive a circuit card of a different mating connector therein, the signal conductors each having a mating contact that extends from a front edge surface of the respective signal holder, the mating contact of at least one signal conductor extending into the upper port, the mating contact of at least another signal conductor extending into the lower port, the ground conductors each having a mating contact that extends from a front edge surface of the respective ground holder, the mating contact of at least one ground conductor extending into the upper port, and the mating contact of at least another ground conductor extending into the lower port.

13. The electrical connector of claim 1, wherein a first portion of the ground holder of each ground wafer is composed of the lossy material, and a second portion of the ground holder is composed of a low loss dielectric material, at least one of the ground conductors of the corresponding ground wafer extending through the first portion and engaging the lossy material along a first segment of the ground conductor and extending through the second portion and engaging the low loss dielectric material of the ground holder along a different, second segment of the ground conductor.

14. The electrical connector of claim 13, wherein the ground conductors of each ground wafer includes a first ground conductor and a second ground conductor, the first ground conductor extending through and engaging the lossy material along a first segment of the first ground conductor and extending through and engaging the low loss dielectric material along a different, second segment of the first ground conductor, the second ground conductor extending through and engaging the lossy material, the second ground conductor being spaced apart from the low loss dielectric material in the second portion of the ground holder.

15. An electrical connector comprising:

a housing having a mounting side and a front side, the front side configured to mate with at least one mating connector; and a plurality of ground wafers and signal wafers stacked next to one another along a stack axis, the signal wafers being stacked in pairs and the ground wafers being interleaved between adjacent pairs of the signal wafers, each signal wafer including at least two signal conductors held by a signal holder that is composed of a low loss dielectric material, each ground wafer including at least two ground conductors held by a ground holder, a first portion of the ground holder of each ground wafer is composed of a lossy material and a second portion of the ground holder is composed of a low loss dielectric material, the low loss dielectric material of the signal holder and the low loss dielectric material of the second portion of the ground holder each having a respective loss tangent that is lower than a loss tangent of the lossy material of the first portion of the ground holder, the signal conductors and the ground conductors being configured to engage and electrically connect to the at least one mating connector, wherein a first ground conductor of the ground conductors of each ground wafer extends through the first portion of the ground holder and engages the lossy material along a first segment of the first ground conductor, the first ground conductor extending through the second portion of the ground holder and engaging the low loss dielectric material of the ground holder along a different, second segment of the first ground conductor.

16. The electrical connector of claim 15, wherein each ground wafer includes a long ground conductor and a short ground conductor that is shorter than the long ground conductor, the long ground conductor being the first ground conductor that extends through both the first portion and the second portion of the ground holder, the short ground conductor extending through the first portion of the ground holder and engaging the lossy material, the short ground conductor being spaced apart from the second portion of the ground holder and the low loss dielectric material thereof.

17. The electrical connector of claim 16, wherein the front side of the housing includes an upper port and a lower port, each of the upper and lower ports being configured to receive a circuit card of a respective different mating connector therein, the long ground conductor including a mating contact that extends from a front edge surface of the ground holder into the upper port, the short ground conductor including a mating contact that extends from the front edge surface into the lower port.

18. The electrical connector of claim 15, wherein the first ground conductor includes an upper segment, a lower segment, and a middle segment disposed between the upper and lower segments along a length of the first ground conductor, the upper segment and the lower segment of the first ground conductor extending through the first portion of the ground holder and engaging the lossy material, the middle segment of the first ground conductor extending through the second portion of the ground holder and engaging the low loss dielectric material of the ground holder.

19. The electrical connector of claim 15, wherein each ground conductor is held between a left side and an opposite right side of the respective ground holder, the left and right sides of the ground holder being defined by the lossy material along the first portion of the ground holder, the left and right sides of the ground holder being defined by the low loss dielectric material along the second portion of the ground holder.

20. The electrical connector of claim 15, wherein the low loss dielectric material of the signal holder and the low loss dielectric material of the second portion of the ground holder each have a loss tangent that is no more than one-tenth of a loss tangent of the lossy material of the first portion of the ground holder.

* * * * *